US011319764B2

(12) United States Patent
Messa et al.

(10) Patent No.: US 11,319,764 B2
(45) **Date of Patent: *May 3, 2022**

(54) DOWNHOLE PULSING-SHOCK REACH EXTENDER SYSTEM

(71) Applicant: PETROSTAR SERVICES, LLC, San Antonio, TX (US)

(72) Inventors: Richard Messa, Broussard, LA (US); Christopher Gasser, Houston, TX (US); Brady Guilbeaux, Maurice, LA (US); Ashley Rochon, New Iberia, LA (US)

(73) Assignee: PETROSTAR SERVICES, LLC, San Antonio, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/782,960

(22) Filed: Oct. 13, 2017

(65) Prior Publication Data

US 2018/0179841 A1 Jun. 28, 2018

Related U.S. Application Data

(63) Continuation-in-part of application No. 15/428,792, filed on Feb. 9, 2017, which is a continuation-in-part of application No. 15/392,846, filed on Dec. 28, 2016, now abandoned.

(51) Int. Cl.

| | |
|---|---|
| ***E21B 28/00*** | (2006.01) |
| ***E21B 34/14*** | (2006.01) |
| ***E21B 4/02*** | (2006.01) |
| ***E21B 7/04*** | (2006.01) |

(52) U.S. Cl.
CPC ..... *E21B 28/00* (2013.01); *E21B 34/14* (2013.01); *E21B 4/02* (2013.01); *E21B 7/046* (2013.01)

(58) Field of Classification Search
CPC . E21B 28/00; E21B 34/14; E21B 4/02; E21B 7/046
See application file for complete search history.

(56) References Cited

U.S. PATENT DOCUMENTS

| | | | | |
|---|---|---|---|---|
| 2,576,923 | A | 12/1951 | Coberly | |
| 3,045,749 | A * | 7/1962 | Brandon | E21B 28/00 166/249 |
| 6,053,261 | A * | 4/2000 | Walter | E21B 4/14 175/234 |
| 6,279,670 | B1 * | 8/2001 | Eddison | E21B 4/02 175/107 |
| 7,343,982 | B2 | 3/2008 | Mock et al. | |
| 8,082,941 | B2 | 12/2011 | Caccialupi et al. | |

(Continued)

*Primary Examiner* — Christopher J Sebesta
*Assistant Examiner* — Neel Girish Patel
(74) *Attorney, Agent, or Firm* — Jason P. Mueller; FisherBroyles, LLP

(57) ABSTRACT

A downhole pulsing-shock reach extender apparatus for overcoming static friction resistance in coiled-tubing drilling-fluid-pressure driven downhole operations, generating pulsed hydraulic shocks at the workstring by creating a fluid-hammer condition by repeated sudden opening and closing of a valve controlling a diverted portion of the flow of drilling fluid, while maintaining a constant flow of a portion of drilling fluid sufficient to operate and prevent damage to other components of the workstring, thereby extending the depth limit of downhole operations.

12 Claims, 7 Drawing Sheets

(56) References Cited

U.S. PATENT DOCUMENTS

| | | | | |
|---|---|---|---|---|
| 8,939,217 | B2 * | 1/2015 | Kolle | E21B 28/00 166/373 |
| 8,967,268 | B2 * | 3/2015 | Urban | E21B 21/103 166/320 |
| 9,371,692 | B2 * | 6/2016 | Eddison | E21B 4/14 |
| 2006/0272821 | A1 * | 12/2006 | Webb | E21B 7/18 166/305.1 |
| 2007/0187112 | A1 * | 8/2007 | Eddison | E21B 28/00 166/380 |
| 2009/0139769 | A1 * | 6/2009 | Traylor | F03B 13/02 175/57 |
| 2010/0243265 | A1 * | 9/2010 | Sherrill | E21B 41/0085 166/373 |
| 2012/0067647 | A1 * | 3/2012 | Savage | E21B 7/24 175/61 |
| 2012/0186878 | A1 * | 7/2012 | Eddison | E21B 4/14 175/57 |
| 2012/0312540 | A1 * | 12/2012 | Lefebvre | E21B 43/20 166/319 |
| 2014/0041943 | A1 * | 2/2014 | Lanning | E21B 21/103 175/57 |
| 2014/0048283 | A1 * | 2/2014 | Mohon | E21B 28/00 166/374 |
| 2015/0211300 | A1 * | 7/2015 | Kettels | E21B 1/00 175/57 |
| 2016/0130938 | A1 | 5/2016 | Koll | |
| 2016/0305188 | A1 * | 10/2016 | Hay | E21B 47/18 |
| 2016/0312559 | A1 | 10/2016 | Gotlib et al. | |

* cited by examiner

DOWNHOLE PULSING-SHOCK REACH EXTENDER SYSTEM

CROSS-REFERENCE TO RELATED APPLICATIONS

This application is a continuation-in-part of my co-pending application Ser. No. 15/428,792, filed Feb. 9, 2017 for a "Downhole Fluid-Pressure Safety Bypass Apparatus," which is a continuation-in-part of my application Ser. No. 15/392,846, filed Dec. 28, 2016 for a "Downhole Pulsing Shock-Reach Extender System," currently pending, the full disclosures of which are incorporated by reference herein and priority of which is hereby claimed.

BACKGROUND

This invention is a downhole pulsing-shock reach extender apparatus for overcoming static friction resistance in coiled-tubing drilling-fluid-pressure driven downhole operations.

Drilling, in its broad sense, includes not only the initial drilling of a hole, but many subsequent trips down the hole for workover and inspection. Where older methods of drilling use sections of rigid pipe threaded together, coiled-tubing drilling uses a somewhat flexible, continuous tube that can be spooled when not in use. The power for rigid-pipe drilling is applied at the turntable on the rig; the power for coiled-tubing drilling, in contrast, is applied at or near the drill bit or workstring, by converting pressure applied to drilling fluid or drilling mud at the wellhead, transmitted down the great length of coiled tubing, and converted to rotational force by a fluid motor or mud motor. This technique allows for directional drilling, including horizontal drilling, and accordingly includes changes of direction during drilling. In coiled-tubing operations, the depth of a hole might include substantial portions of horizontal or near-horizontal runs.

In rigid-pipe drilling, the function of drilling fluid or drilling mud is to provide lubrication, flushing of tailings, and counter pressure down the hole. Coiled-tubing drilling uses the drilling fluid or mud for an additional purpose of transmitting power or force to the workstring, which is thousands of feet distant, underground.

Coiled-tubing operations will always encounter increased resistance at increasing depths. Although the coiled tubing is straightened before insertion, there is a likelihood of some residual shape memory to nudge the deployed tubing away from perfectly straight, given its original coiled shape. Directional drilling usually involves changes of direction, and each change of direction provides a point of increased drag while diminishing any benefit from downward, insertion force applied at the wellhead. Because there is likely to be at least some drag all along the surface of the deployed tubing, a longer, or deeper, run will encounter, increasing total drag. Very deep coiled-tubing operations therefore encounter increased drag, or static friction, which eventually cannot be overcome. This limits the depths attainable by the operation.

It is known that a given amount of force, when applied gradually or constantly, will not be sufficient to overcome static friction, but that the same total amount of force, when applied as pulses, will overcome the static friction. A nail that cannot be pressed into a block of wood can be hammered into it. The pulse of force is able to work as intended for a brief time before being dispersed. But any pulse of more pressure applied at the wellhead will dissipate, and will not be felt at the distant workstring. All changes of pressure at the workstring will necessarily be gradual, buffered changes. If too great an amount of mud pressure is forced down the coiled tubing, it will damage or destroy the mud motor.

The present art does not provide an effective way of generating pulses of hydraulic shock within the workstring itself, while avoiding the application of too much pressure within the long run of coiled tubing and at the workstring, and while avoiding damage to mud motors and other components of the workstring.

U.S. Publ. No. 2016/0312559 was published on Oct. 27, 2016 by inventors Ilia Gotlib et al. and assignee Schlumberger Technology Corp., and covers a "Pressure Pulse Reach Extension Technique." The pressure pulse tool and technique allows for a reciprocating piston at a frequency independent of a flow rate of the fluid that powers the reciprocating. The architecture of the tool and techniques employed may take advantage of a Coanda or other implement to alternatingly divert fluid flow between pathways in communication with the piston in order to attain the reciprocation. Frequency of reciprocation may be between about 1 Hz and about 200 Hz, or other suitably tunable ranges. Once more, the frequency may be enhanced through periodic exposure to annular pressure. Extended reach through use of such a pressure pulse tool and technique may exceed about 2,000 feet.

U.S. Publ. No. 2016/0130938 was published on May 12, 2016 by inventor Jack J. Koll and assignee Tempress Technologies, Inc., and discloses "Seismic While Drilling System and Methods." A bottom hole assembly is configured with a drill bit section connected to a pulse generation section. The pulse generation section includes a relatively long external housing, a particular housing length being selected for the particular drilling location. The long external housing is positioned closely adjacent to the borehole sidewalls to thereby create a high-speed flow course between the external walls of the housing and the borehole sidewalls. The long external housing includes a valve cartridge assembly and optionally a shock sub decoupler. While in operation, the valve cartridge assembly continuously cycles and uses downhole pressure to thereby generate seismic signal pulses that propagate to geophones or other similar sensors on the surface. The amount of bypass allowed through the valve assembly is selectable in combination with the long external housing length and width to achieve the desired pulse characteristics. The bottom hole assembly optionally includes an acoustic baffle to attenuate wave propagation going up the drill string.

U.S. Publ. No. 2014/0048283, published by Brian Mohon et al. on Feb. 20, 2014, covers a "Pressure Pulse Well Tool." The disclosure of the Mohen publication is directed to a pressure pulse well tool, which may include an upper valve assembly configured to move between a start position and a stop position in a housing. The pressure pulse well tool may also include an activation valve subassembly disposed within the upper valve assembly. The activation valve subassembly may be configured to restrict a fluid flow through the upper valve assembly and increase a fluid pressure across the upper valve assembly. The pressure pulse well tool may further include a lower valve assembly disposed inside the housing and configured to receive the fluid flow from the upper valve assembly. The lower valve assembly may be configured to separate from the upper valve assembly after the upper valve assembly reaches the stop position, causing the fluid flow to pass through the lower valve assembly and to decrease the fluid pressure across the upper valve assembly.

U.S. Pat. No. 8,082,941 issued Dec. 27, 2011 to Alessandro O. Caccialupi et al. for a "Reverse Action Flow Activated Shut-Off Valve." The Caccialupi flow-activated valve includes an outer body and a piston disposed in an inner cavity of the outer body. The flow-activated valve also includes one or more fluid passage exits in the outer body and one or more piston fluid passages in the piston. The one or more fluid passage exits and the one or more piston fluid passages allow fluid flow out of the valve. The flow-activated valve also includes a flow restriction member disposed in a piston inner cavity. In addition, the flow-activated valve includes a shear member disposed in the outer body, and a bias member disposed in an inner cavity of the outer body. The flow-activated valve further includes a position control member disposed in the piston and a sealing member.

U.S. Pat. No. 7,343,982 issued to Phil Mock et al. on Mar. 18, 2008 for a "Tractor with Improved Valve System." The system covers a hydraulically powered tractor adapted for advancement through a borehole, and includes an elongated body, aft and forward gripper assemblies, and a valve control assembly housed within the elongated body. The aft and forward gripper assemblies are adapted for selective engagement with the inner surface of the borehole. The valve control assembly includes a gripper control valve for directing pressurized fluid to the aft and forward gripper assemblies. The valve control assembly also includes a propulsion control valve for directing fluid to an aft or forward power chamber for advancing the body relative to the actuated gripper assembly. Aft and forward mechanically actuated valves may be provided for controlling the position of the gripper control valve by detective and signaling when the body has completed an advancement stroke relative to an actuated gripper assembly. Aft and forward sequence valves may be provided for controlling the propulsion control valve by detecting when the gripper assemblies become fully actuated. A pressure relief valve is preferably provided along an input supply line for liming the pressure of the fluid entering the valve control assembly.

U.S. Pat. No. 2,576,923, issued on Dec. 4, 1951 to Clarence J. Coberly for a "Fluid Operated Pump with Shock Absorber," relates in general to equipment for pumping fluid from wells and, more particularly, to an apparatus which includes a reciprocating pump of the fluid-operated type. A primary object of the invention is to provide an apparatus having cushioning means associated therewith for absorbing any fluid pressure variations which may impose hydraulic shock loads on the system. The fluid operated pumping unit includes a combination of (1) a source of a first fluid at a substantially constant pressure level; (2) a receiver for a second fluid to be pumped; (3) a pump adapted to be operating by the first fluid to pump the second fluid; (4) a shock absorber connected to the pump and having movable fluid separating means within it; (5) means for a first passage communicating between the source and the shock absorber for admitting the first fluid into the shock absorber on one side of the fluid separating means; (6) and a second passage means communicating between the receiver and the shock absorber for admitting the second fluid into the shock absorber on the opposite side of the fluid separating means.

U.S. Pat. No. 8,967,268, issued to Larry J. Urban et al. on Mar. 3, 2015, covers "Setting Subterranean Tools with Flow Generated Shock Wave." In the Urban patent, a circulation sub is provided that has a ball seat and a circulation port that is closed when a ball is landed on the seat. An axial passage directs the pressure surge created with the landing of the ball on the seat to the port with the actuation piston for the tool. The surge in pressure operations the actuation piston to set the tool, which is preferably a packer. Raising the circulation rate through a constriction in a circulation sub breaks a shear device and allows the restriction to shift to cover a circulation port. The pressure surge that ensues continues through the restriction to the actuating piston for the tool to set the tool. The Urban patent was assigned to Baker Hughes Inc. on Nov. 30, 2011.

U.S. Pat. No. 8,939,217, issued Jan. 27, 2015 to inventor Jack J. Koll and assignee Tempress Technologies, Inc., covers a "Hydraulic Pulse Valve with Improved Pulse Control." Hydraulic pulses are produced each time that a pulse valve interrupts the flow of a pressurized fluid through a conduit. The pulse valve includes an elongated housing having an inlet configured to couple the conduit to receive the pressurized fluid, and an outlet configured to couple to one or more tools. In the housing, a valve assembly includes a poppet reciprocating between open and closed positions, and a poppet seat, in which the poppet closes to at least partially block the flow of pressurized fluid through the valve. A pilot within the poppet moves between disparate positions to modify fluid paths within the valve. When the valve is open, a relatively lower pressure is produced by a Venturi effect as the fluid flows through a throat in the poppet seat, to provide a differential pressure used to move the pilot and poppet. An optional bypass reduces the pulse amplitude.

SUMMARY OF THE INVENTION

The present invention provides a downhole pulsing-shock reach extender apparatus for overcoming static friction resistance in coiled-tubing drilling-fluid-pressure driven downhole operations, generating pulsed hydraulic shocks at the workstring by creating a fluid-hammer condition by repeated sudden opening and closing of a valve, controlling a diverted portion of the flow of drilling fluid while maintaining a constant flow of a portion of drilling fluid sufficient to operate and prevent damage to other components of the workstring, thereby extending the depth limit of downhole operations.

BRIEF DESCRIPTION OF DRAWINGS

Reference will now be made to the drawings, wherein like parts are designated by like numerals, and wherein.

DETAILED DESCRIPTION OF THE INVENTION

Figure 1:
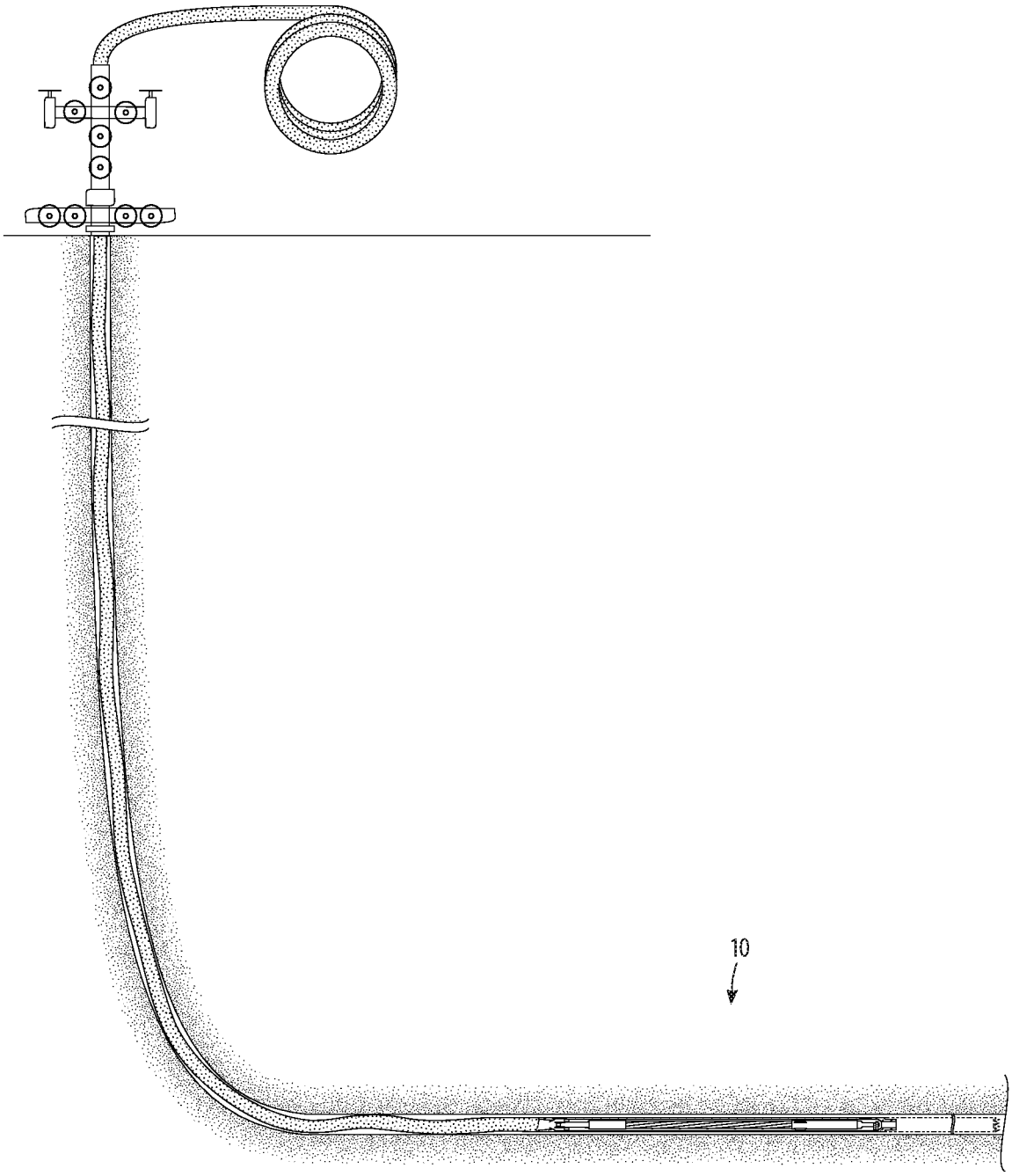
FIG. 1 is a schematic view illustrating the downhole pulsing-shock reach extender of the invention in use.

Referring to FIG. 1, the downhole pulsing-shock reach extender 10 of the invention is shown schematically, in use in coiled-tubing, directional drilling, downhole operations.

The downhole pulsing-shock reach extender 10 assists significantly in overcoming the static friction encountered in deep directional-drilling downhole coiled-tubing operations by generating pulsed hydraulic shocks, which are a pulsation of energy at the workstring, by creating a fluid-hammer condition using an essentially constant or slowly changing normal drilling-fluid pressure which will not damage other components of the workstring, thereby extending the depth limit of downhole operations.

The downhole pulsing-shock reach extender 10 generates a force, during a small window of time, that is able to work as intended before being dispersed, in a continuing cycle. No pulsation from the wellhead can effectively reach the workstring. Moreover, the application of an extreme amount of pressure will only damage or destroy the workstring's components. The downhole pulsing-shock reach extender 10 generates the needed pulsing shocks at the needed locus of the workstring, using the available, normal mud pressure, and without exposing the other components of the workstring to damage or destruction from excessive pressures.

The hammer or shock set up in the drilling mud inside the downhole pulsing-shock reach extender 10 will impart a jerk, also known as jolt, surge, or lurch, to the body of the extender and to the other elements of the workstring, causing a mechanical or physical shock that assists the workstring in overcoming static friction. The downhole pulsing-shock reach extender 10 is designed to be made up above the mud motor. It interrupts the flow of drilling fluid utilizing a fluid-hammer effect, and causes the workstring to expand and contract above the tool. This allows the tool to "walk," and to give extended reach to the workstring.

Figure 5:
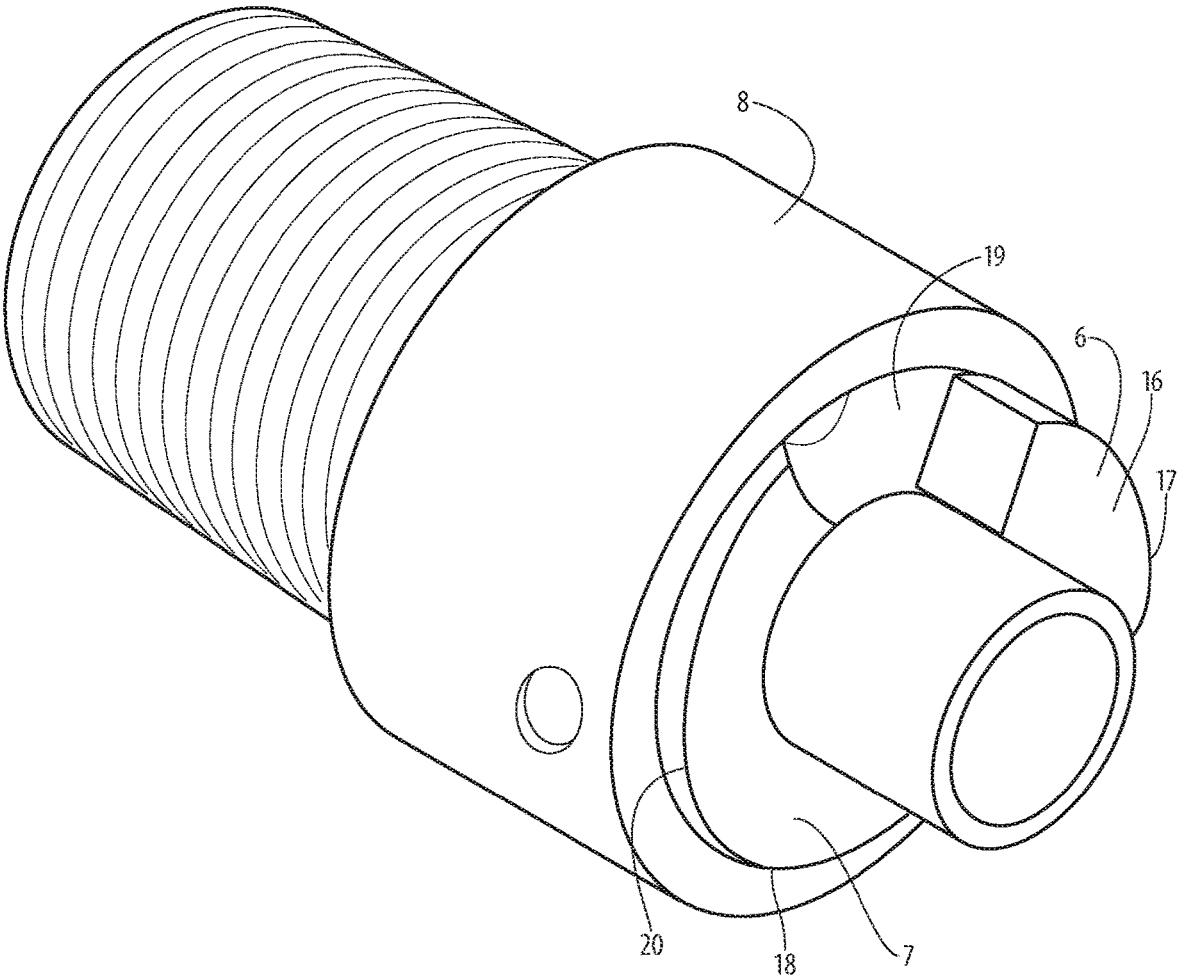
FIG. 5 is a perspective detail view of the downhole portion of the downhole pulsing-shock reach extender of the invention.
Figure 6:
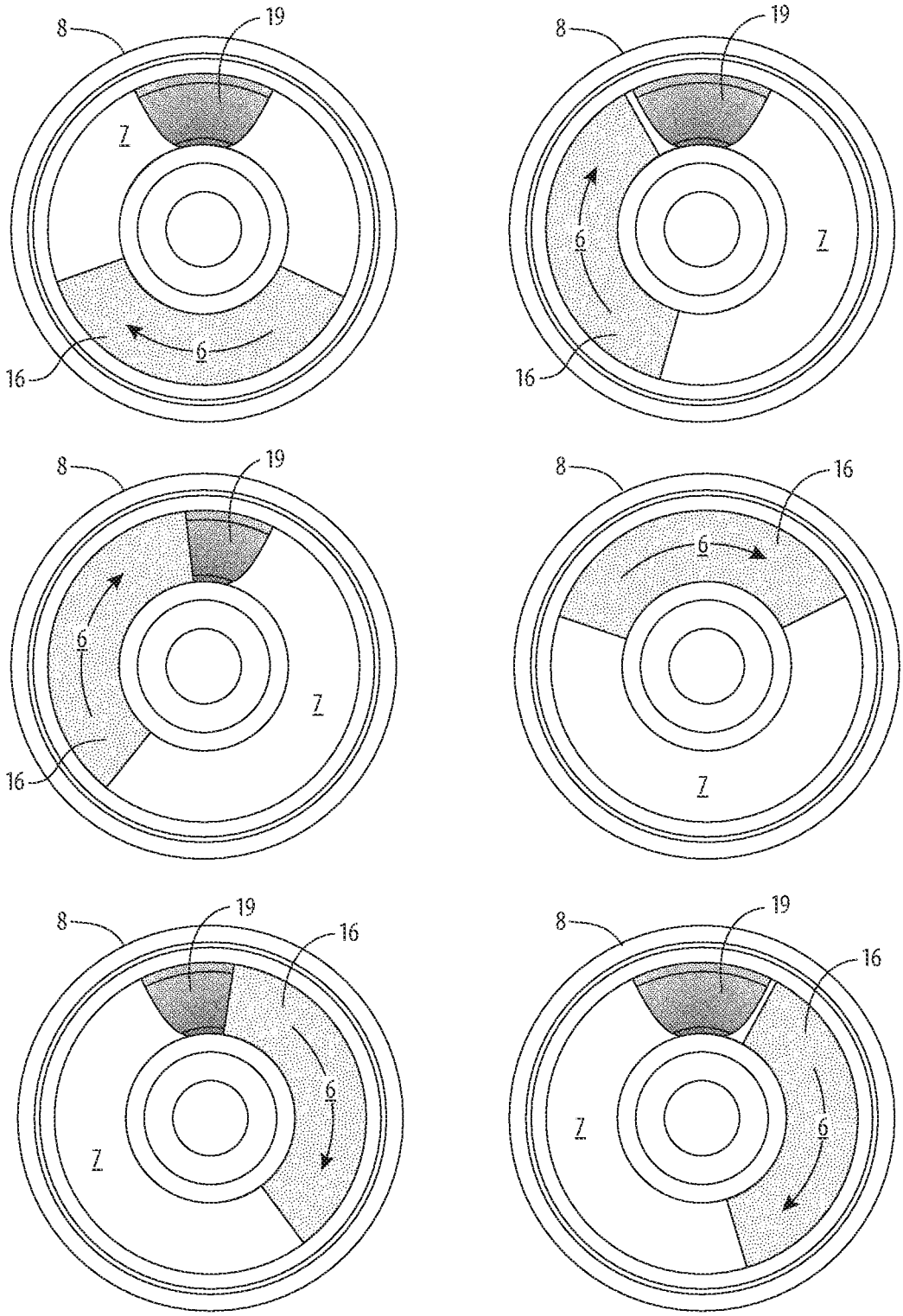
FIG. 6 is six sectional views of the downhole portion of the downhole pulsing-shock reach extender of the invention in use.

Referring additionally to FIG. 5 & FIG. 6, the method used to interrupt the flow in this tool is a foot valve housed in a bottom sub 8, at the downhole or bottom end of the downhole pulsing-shock reach extender 10, having a set of plates, one stationary and one rotating, with a fluid path through them, all driven by a fluid-actuated motor. As can be seen in particular detail in FIG. 5, the foot-valve top plate 6 comprises an arcuate shutter member 16 having an outer curvature 17 that matches an outer curvature 18 of the foot-valve bottom plate 7. The foot-valve bottom plate 7 has a cutout 19 that extends from an outer curved edge 20 of the foot-valve bottom plate 7 towards a center thereof. As shown in FIGS. 5 and 6, the cutout 19 is formed off center. When the cutout 19 is covered by the shutter member 16, no fluid flow is allowed through the off-center cutout 19. As can be seen in FIG. 6, the surface area of the shutter member 16 is greater than the opening formed by the cutout 19. As the foot-valve top plate 6 turns in relation to the stationary foot-valve bottom plate 7, the fluid path lines up temporarily in an open position, opening the cutout 19, and allowing fluid to flow, before being interrupted as the plate continues to turn, increasing the pressure and causing the fluid hammer. As schematically shown in FIG. 6, when the foot-valve bottom plate 6 is turned, the shutter member 16 gradually covers the cutout 19 until the entire passage formed by the cutout 19 is blocked, the off-center fluid pass is closed off, and no fluid flows through the foot-valve bottom plate 7.

Figure 2:
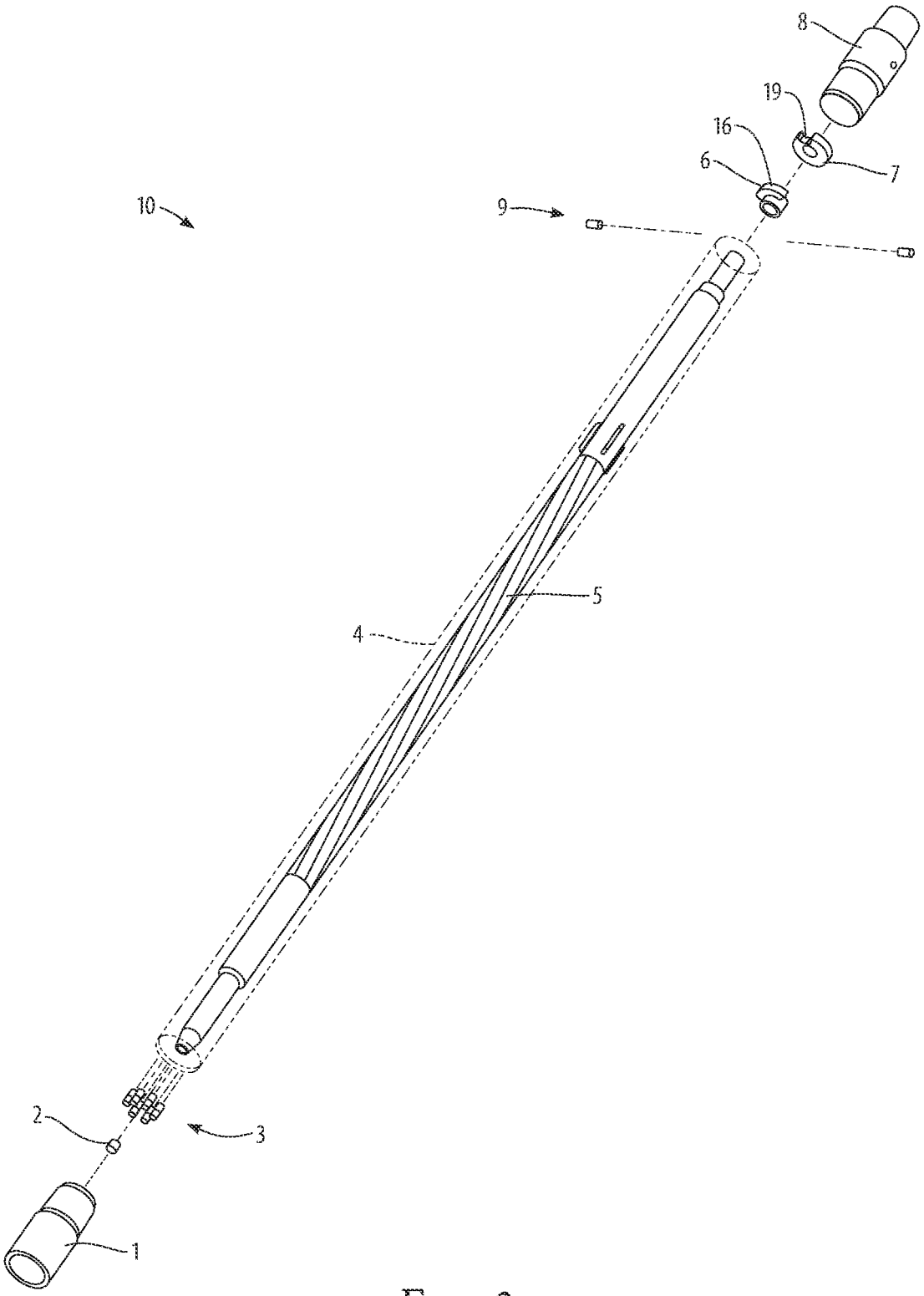
FIG. 2 is an exploded view of the downhole pulsing-shock reach extender of the invention.

Referring now to FIG. 2, the downhole pulsing-shock reach extender 10 provides a tool housing 4 enclosing a fluid motor 5. The fluid motor 5, or mud motor, converts some of the energy from pressurized drilling fluid or drilling mud flowing through it into rotational energy or torque to rotate the foot-valve top plate 6. The fluid motor 5 has a central axial opening forming a tube that conveys drilling fluid or drilling mud from the up-hole or top end to the downhole or bottom end, and then the drilling fluid flows on into the downhole workstring components such as the drilling bit. The outer circumference of the fluid motor 5 is smaller than the inner circumference of the tool housing 4 so that a perimeter fluid channel is formed, allowing the flow of drilling fluid around the fluid motor 5 instead of through it. One advantage of this perimeter fluid channel is that it provides for improved cooling and lubrication of the fluid motor 5 in relation to a fluid motor that is directly exposed to the well bore.

On the downhole end of the downhole pulsing-shock reach extender 10 is attached the bottom sub 8 housing the foot-valve top plate 6 and foot-valve bottom plate 7. In a preferred embodiment, a lock pin 9 or lock pins are used to reinforce the screw-thread attachment of the bottom sub 8 to the tool housing 4 against the rotational force acting to unscrew it, and therefore also maintaining the relative orientation of the opening in the foot-valve bottom plate 7. Both the foot-valve top plate 6 and the foot-valve bottom plate 7 have central axial openings corresponding to the central axial opening of the fluid motor 5, allowing the constant, unimpeded flow of drilling fluid from the drilling motor 5, through the bottom sub 8, and on to the downhole components of the workstring.

Figure 7:
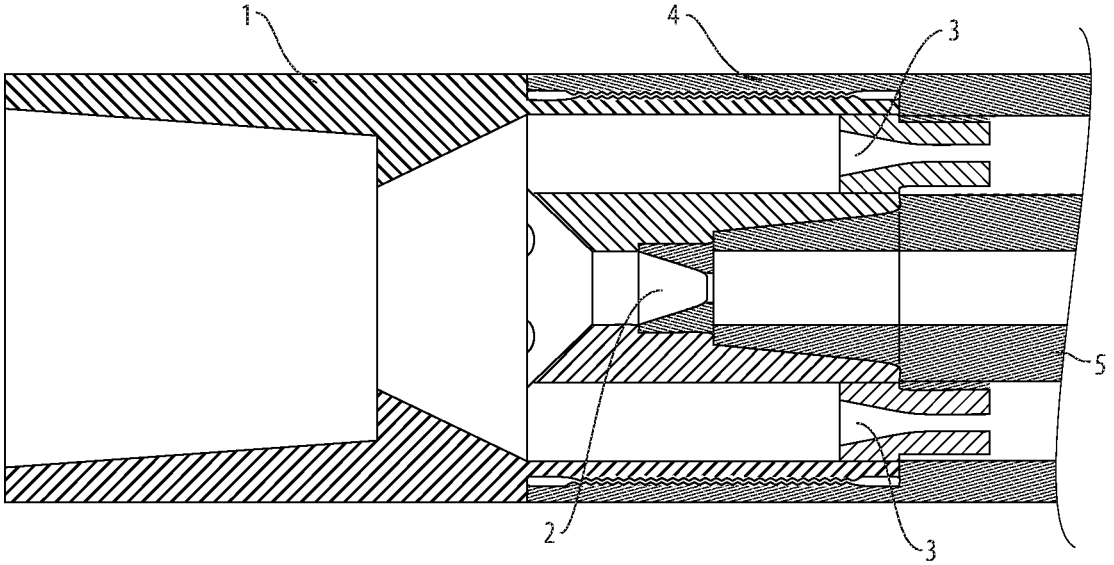
FIG. 7 is two sectional views of the up-hole portion of the downhole pulsing-shock reach extender of the invention.
Figure 7:
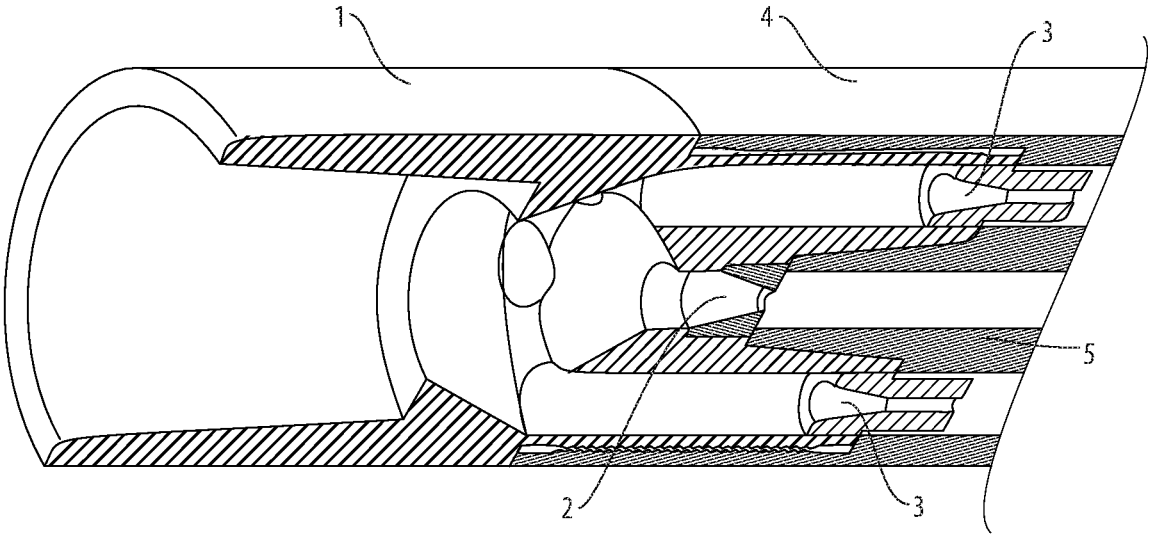

Referring additionally to FIG. 7, on the up-hole end of the downhole pulsing-shock reach extender 10 is attached the top sub 1, housing a center orifice 2 in alignment with the central axial opening of the fluid motor 5, and several bypass orifices 3 arrayed in alignment with the perimeter fluid channel around the fluid motor 5. By manipulating the opening size of the center orifice 2 and the number of, and opening sizes of, the bypass orifices, the proportions of drilling fluid flowing through the fluid motor 5 and around the fluid motor can be controlled. The proper sizes and numbers of the orifices to meet the needs of a particular drilling operation can be placed into the downhole pulsing-shock reach extender 10 during inspection prior to use. In a preferred embodiment shown, six bypass orifices can be placed into the top sub 1.

The orifices 2, 3 will be subject to erosion or washout from extended exposure to turbulent flow, but can be easily replaced during cleaning and inspection of the tool. The adjustability of the flow paths makes for adjustability of the tool response, cycling rate, and amplitude for different flow rates and fluid properties. The adjustability of the flow paths also ensure that the fluid motor 5 can be run at flow rates within its optimum window of operation, and not detrimental to the operating parts within. The orifices 2, 3 are axially aligned with the tool housing 4 and fluid motor 5 so that they exhaust fluid parallel to the other tool surfaces, lessening turbulence and the potential for erosion.

The outer diameters of the tool housing 4, top sub 1, and bottom sub 8 match that of the coiled tubing itself and the other components of the workstring. In an embodiment appropriate for standard 2.375-inch tubing in a 5.5-inch casing, an outer diameter of 2.875 inches is appropriate. An embodiment of the downhole pulsing-shock reach extender 10 is made of steel, as is known in the art. The types of drilling fluid or mud used with coiled-tubing, mud-motor operations will sufficiently cool and lubricate a unit made of steel, and will suppress any potential sparking. Other embodiments could be made from, or could have components made from, non-sparking brass or from non-corroding composite materials, if such qualities are needed.

Figure 3:
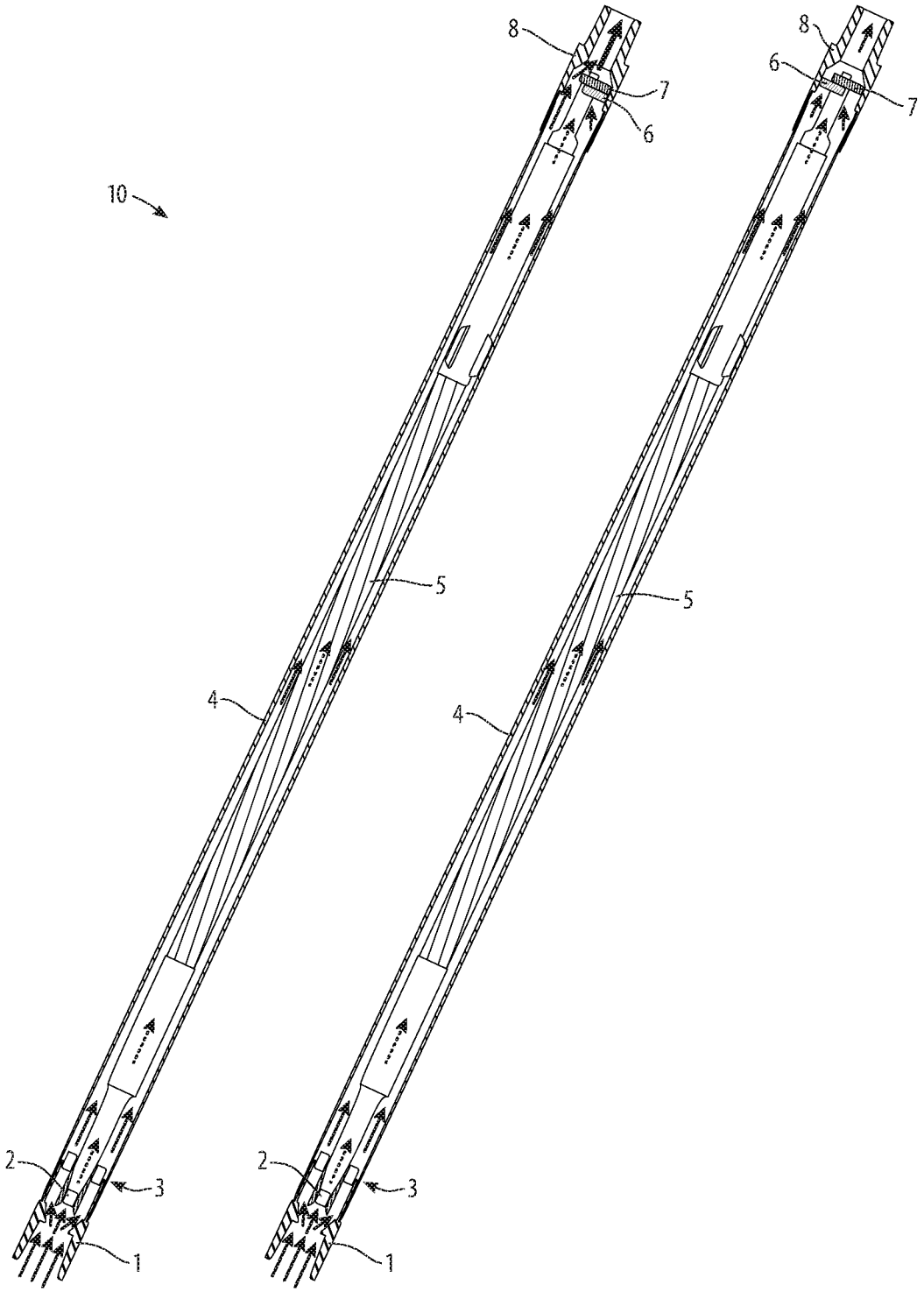
FIG. 3 is two top cutaway views of the downhole pulsing-shock reach extender of the invention with the valve opened and closed.
Figure 4:
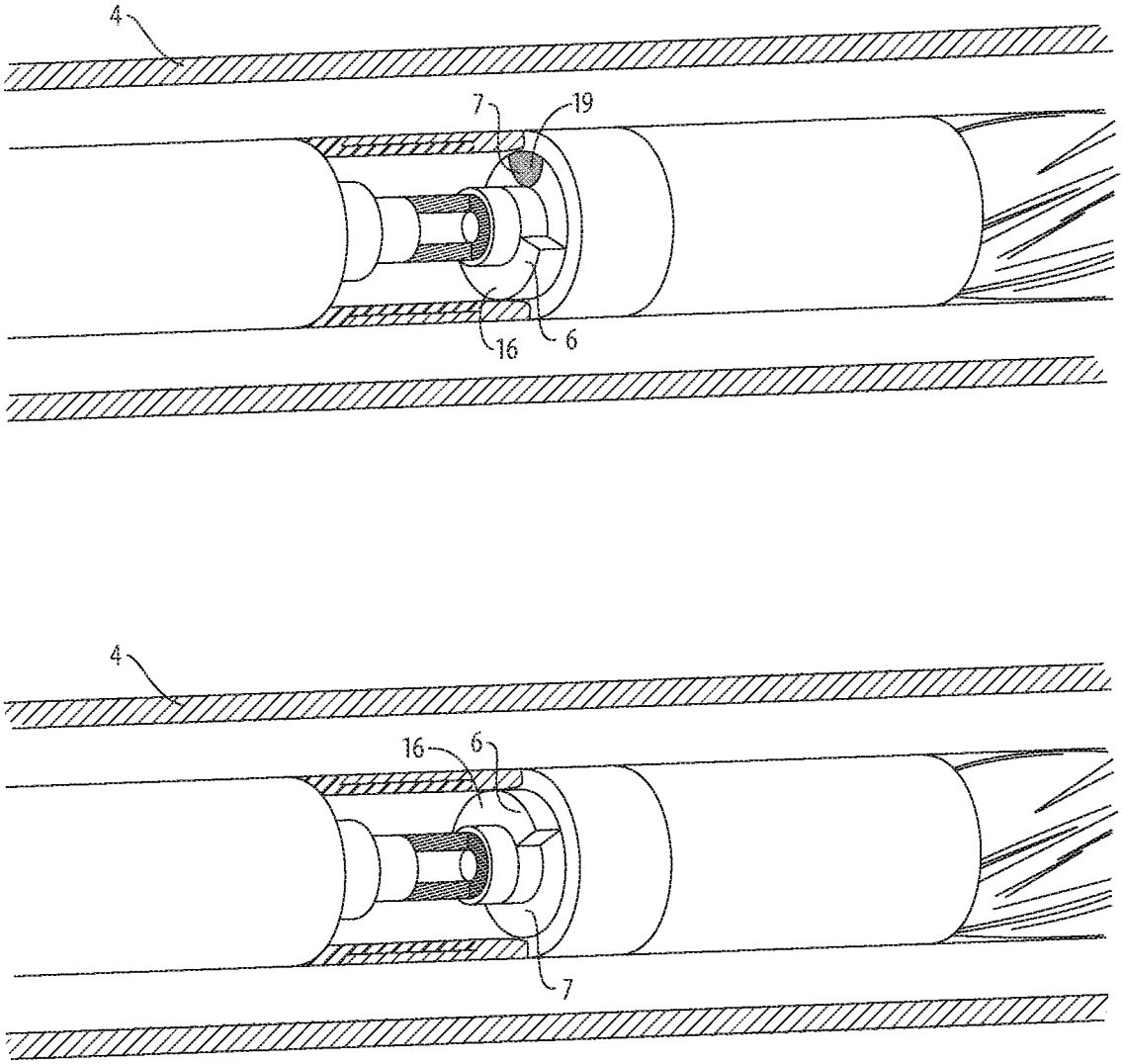
FIG. 4 is two perspective cutaway detail views of a portion of the downhole pulsing-shock reach extender of the invention with the valve opened and closed.

Referring to FIG. 3 & FIG. 4, in use, the downhole pulsing-shock reach extender 10 receives a flow of drilling fluid under pressure into the top sub 1, where the center orifice 2 and the bypass orifices 3 divert a portion of the flow to the perimeter fluid channel surrounding the fluid motor 5, with the remaining flow passing through the fluid motor. The drilling fluid passing through the fluid motor 5 causes the fluid motor 5 to rotate. The downhole end of the fluid motor 5 is connected to the foot-valve top plate 6 such that the rotation of the fluid motor 5 rotates the foot-valve top plate 6. As the foot-valve top plate 6 rotates in relation to the fixed foot-valve bottom plate 7, the foot-valve top plate 6 alternately covers and uncovers an opening through the foot-valve bottom plate 7. When the opening through the foot-valve bottom plate 7 is uncovered, the drilling fluid in the perimeter fluid channel is allowed to flow into the downhole portion of the bottom sub 8, where it combines with the flow through the fluid motor 5, thereby increasing the pressure of the drilling fluid exiting the bottom sub 8 and flowing to the rest of the workstring. The rotating foot-valve top plate 6 then quickly covers the opening through the foot-valve bottom plate 7, blocking the flow from the perimeter fluid channel, while the flow through the fluid motor 5 continues, thereby decreasing the pressure of the fluid exiting the bottom sub 8 and flowing to the rest of the workstring. This continues in a cycle, and the pressure of the drilling fluid flowing out of the bottom sub 8 and to the downhole components of the workstring is pulsed or bumped, but never completely stopped, since the flow through the fluid motor 5, foot-valve top plate 6, and foot-valve bottom plate 7 is never stopped, and the other components of the workstring are never completely starved of mud.

The center orifice 2, bypass orifices 3, foot-valve top plate 6, and foot-valve bottom plate 7 are removable and replaceable parts so that they can be replaced when worn or eroded, and so that parts having appropriately sized openings or open areas can be placed into the downhole pulsing-shock reach extender 10 for optimal performance of a given downhole operation. The top sub 1 and the bottom sub 8 will also be subject to erosion, and can be replaced easily and inexpensively. Different top subs 1, having different numbers or sizes of openings for bypass orifices 3, can be provided to accommodate particular requirements. These orifices, plates, and subs are relatively small and inexpensive, and can be made up from widely available components. The fluid motor 5 is the largest and most expensive component of the downhole pulsing-shock reach extender 10, but is available as a standard, existing part, and the standard fluid motors are made for much more taxing applications, and should not be subject to undue or accelerated wear in the downhole pulsing-shock reach extender 10.

Many other changes and modifications can be made in the system and method of the present invention without departing from the spirit thereof. We therefore pray that our rights to the present invention be limited only by the scope of the appended claims.

We claim:

1. A downhole pulsing-shock reach extender comprising:

(i) a tubular tool housing adapted to being mounted in a workstring, and having, an up-hole end and a downhole end;

(ii) a top sub adapted to connect the up-hole end of the tool housing to the workstring, and having a central axial opening;

(iii) a bottom sub adapted to connect the downhole end of the tool housing to the workstring, and having a central axial opening;

(iv) a fluid motor axially mounted inside the tool housing forming a perimeter fluid channel between the fluid motor and an interior wall of the tool housing, wherein the fluid motor has a central axial opening, wherein the fluid motor is adapted to rotate in response to a flow of drilling fluid;

(v) a changeable center orifice mounted within the top sub, in line with the central axial opening of the fluid motor;

(vi) at least one changeable bypass orifice mounted within the top sub, in line with the perimeter fluid channel;

(vii) a foot-valve bottom plate with a central axial opening in fluid communication with the central axial opening of the fluid motor, wherein the foot-valve bottom plate is fixedly mounted inside the bottom sub, wherein the foot-valve bottom plate has a circular up-hole surface with at least one void-extending from an outer circumferential edge of the foot-valve bottom plate toward a center of the foot-valve bottom plate and in line with the perimeter fluid channel; and (viii) a foot-valve top plate rotatingly mounted inside the bottom sub immediately up-hole of the foot-valve bottom plate, wherein the foot-valve top plate is connected to and rotates with the fluid motor, wherein the foot-valve top plate has a central axial opening in fluid communication with the central axial opening of the fluid motor, wherein the central axial openings of the foot-valve bottom plate and the foot valve top plate define a constant fluid flow path from the central axial opening of the fluid motor through the foot-valve plates, and wherein the foot-valve top plate has a shutter member having a downhole surface with a radius as large or larger than a radius of the foot-valve bottom plate, wherein the shutter member is adapted to alternately block and not block the at least one void in the up-hole surface of the foot-valve bottom plate, during rotation of the foot-valve top plate wherein the void of the foot-valve bottom plate defines a pulsating fluid flow path from the perimeter fluid channel through the foot-valve plates, wherein the constant fluid flow path and pulsating fluid flow path are fluidly isolated from one another through the foot-valve plates.

2. The downhole pulsing-shock reach extender of claim 1, wherein said tool housing, top sub, and bottom sub are made of steel.

3. The downhole pulsing-shock reach extender of claim 1, wherein said changeable center orifice and changeable bypass orifices are made of steel.

4. The downhole pulsing-shock reach extender of claim 1, wherein said foot-valve bottom plate and foot-valve top plate are made of steel.

5. The downhole pulsing-shock reach extender of claim 1, wherein said changeable bypass orifices are configured to divert from 10% to 33%, inclusive, of the volume of the drilling fluid flowing into an up-hole end of the top sub.

6. The downhole pulsing-shock reach extender of claim 1, wherein said changeable bypass orifices are configured to divert not greater than half of the volume of the drilling fluid flowing into an up-hole end of the top sub.

7. The apparatus of claim 1, wherein the shutter member has an outer curvature that matches an outer curvature of the foot-valve bottom plate.

8. The apparatus of claim 1, wherein a surface area of the downhole surface of the shutter member is greater than a cross-sectional area of the void in the circular up-hole surface of the foot-valve bottom plate.

9. A method, comprising:

inserting a workstring into a hole;

pumping drilling fluid down the workstring, wherein the workstring comprises a downhole pulsing-shock reach extender comprising:

(i) a tubular tool housing adapted to being mounted in the workstring, having, in use, an up-hole end and a downhole end;

(ii) a top sub adapted to connect the up-hole end of the tool housing to the coiled-tubing workstring, the top sub having a central axial opening allowing a flow of the drilling fluid;

(iii) a bottom sub adapted to connect the downhole end of the tool housing to the coiled-tubing workstring, the bottom sub having a central axial opening allowing a flow of the drilling fluid;

(iv) a fluid motor axially mounted inside the tool housing, forming a perimeter fluid channel between the fluid motor and an interior wall of the tool housing, the fluid motor having a central axial opening for the flow of the drilling fluid, the fluid motor configured to rotate in response to a flow of the drilling fluid;

(v) a changeable center orifice mounted within the top sub, in line with the central axial opening of the fluid motor;

(vi) at least one changeable bypass orifice mounted within the top sub, in line with the perimeter fluid channel between the tool housing and the fluid motor;

(vii) a foot-valve bottom plate with a central axial opening in fluid communication with the central axial opening of the fluid motor, fixedly mounted inside the bottom sub, the foot-valve bottom plate having a circular up-hole surface with at least one void extending from an outer circumferential edge of the foot-valve bottom plate toward a center thereof and in line with the perimeter fluid channel; and (viii) a foot-valve top plate rotatingly mounted inside the bottom sub immediately up-hole of the foot-valve bottom plate, the foot-valve top plate connected to the fluid motor to rotate with the fluid motor, having a central axial opening in fluid communication with the central axial opening of the fluid motor, wherein the central axial openings of the foot-valve bottom plate and the foot valve top plate define a constant fluid flow path from the central axial opening of the fluid motor through the foot-valve plates, and having a shutter member having a downhole surface with a radius as large or larger than a radius of the foot-valve bottom plate, wherein the shutter member is adapted to block the at least one void in the up-hole surface of the foot-valve bottom plate and to not block the at least one void in the up-hole surface of the foot-valve bottom plate, in an alternating cycle, during rotation of the foot-valve top plate, wherein the void of the foot-valve bottom plate defines a pulsating fluid flow path from the perimeter fluid channel through the foot-valve plates, wherein the constant fluid flow path and pulsating fluid flow path are fluidly isolated from one another through the foot-valve plates.

10. The method of claim 9, further comprising:

attaching a downhole tool on the workstring downhole from the downhole pulsing-shock reach extender.

11. The method of claim 9, further comprising:

inserting the at least one lock pin into the bottom sub and into the foot-valve bottom plate.

12. A method for assembling a downhole pulsing-shock reach extender, the method comprising:

(i) providing a tubular tool housing adapted to being mounted in a coiled-tubing workstring, the tool housing having a first end and a second end;

(ii) connecting a top sub to the first end of the tool housing;

(iii) mounting a fluid motor inside the tool housing such that a perimeter fluid channel is formed between the fluid motor and an interior wall of the tool housing and a central axial opening extends through the fluid motor;

(iv) providing a bottom sub adapted to connect to the second end of the tool housing;

(v) fixedly mounting a foot-valve bottom plate inside the bottom sub, the foot-valve bottom plate having a central axial opening and a circular surface with at least one void extending from an outer circumferential edge of the foot-valve bottom plate toward a center thereof, wherein the void is in line with the perimeter fluid channel;

(vi) inserting at least one lock pin into the bottom sub and into the foot-valve bottom plate;

(vii) rotatingly mounting a foot-valve top plate inside the bottom sub adjacent to the foot-valve bottom plate, the foot-valve top plate having a central axial opening and having a shutter member having a surface with a radius as large or larger than a radius of the foot-valve bottom plate, wherein the shutter member is adapted to block the at least one void in the surface of the foot-valve bottom plate and to not block the at least one void in the surface of the foot-valve bottom plate, in an alternating cycle, during rotation of the foot-valve top plate;

(viii) connecting the foot-valve top plate with the fluid motor such that the central axial opening of the foot-valve top plate is in fluid communication with the central axial opening of the fluid motor;

(ix) connecting the bottom sub with the tool housing, such that the central axial opening of the foot-valve bottom plate is in fluid communication with the central axial opening of the fluid motor wherein the central axial openings of the foot-valve bottom plate and the foot valve top plate define a constant fluid flow path from the central axial opening of the fluid motor through the foot-valve plates and wherein the void of the foot-valve bottom plate defines a pulsating fluid flow path from the perimeter fluid channel through the foot-valve plates, wherein the constant fluid flow path and pulsating fluid flow path are fluidly isolated from one another through the foot-valve plates;

(x) installing at least one changeable bypass orifice within the top sub, in line with the perimeter fluid channel between the tool housing and the fluid motor; and (xi) installing a changeable center orifice within the top sub, in line with the central axial opening of the fluid motor.

* * * * *